US007615916B2

(12) United States Patent
Ryu

(10) Patent No.: US 7,615,916 B2
(45) Date of Patent: Nov. 10, 2009

(54) ELECTRON EMISSION DEVICE INCLUDING ENHANCED BEAM FOCUSING AND METHOD OF FABRICATION

(75) Inventor: Kyung-Sun Ryu, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 504 days.

(21) Appl. No.: 11/136,931

(22) Filed: May 25, 2005

(65) Prior Publication Data

US 2005/0264165 A1 Dec. 1, 2005

(30) Foreign Application Priority Data

May 28, 2004 (KR) ..... 10-2004-0038238

(51) Int. Cl.
*H01J 1/62* (2006.01)
*H01J 63/04* (2006.01)

(52) U.S. Cl. ..... 313/495; 313/496; 313/497; 313/309; 313/351

(58) Field of Classification Search ..... 313/495–497, 313/310, 311
See application file for complete search history.

(56) References Cited

U.S. PATENT DOCUMENTS 5,710,483 A * 1/1998 Peng ..... 313/497
6,075,315 A * 6/2000 Seko et al. ..... 313/336
2003/0057825 A1* 3/2003 Kusunoki et al. ..... 313/495
2004/0135490 A1* 7/2004 Lee et al. ..... 313/495
2005/0082964 A1* 4/2005 Konishi ..... 313/497

FOREIGN PATENT DOCUMENTS

JP 07029484 A * 1/1995

OTHER PUBLICATIONS

T. McKenzie, Development of a Wet Si3N4 Etch Process Utilizing H3PO4 as a Nitride Etchant, Summer 2000, Georgia Institute of Technology Microelectronics Research Center.*

* cited by examiner

*Primary Examiner*—Sikha Roy
(74) *Attorney, Agent, or Firm*—Christie, Parker & Hale, LLP

(57) ABSTRACT

An electron emission device adapted to enhanced electron beam focusing and its method of fabrication are shown. The device includes driving electrodes for controlling the emission of electrons from electron emission regions formed on a substrate; two or more tiers of insulating layers formed on the driving electrodes; and a focusing electrode formed over the tiers. A multi-tiered insulating layer allows a thick tier to hold the focusing electrodes away from the emission regions, thus enhancing their focusing impact, while a thin tier under the focusing electrodes remains amenable to intricate patterning. Fabrication of the tiers from material with different etching rates allows thicker lower support tiers to be etched during the same period and in the same step that a thinner upper tier is etched, also allowing openings in a lower tier to widen while openings in the upper tier stay small.

17 Claims, 5 Drawing Sheets

ELECTRON EMISSION DEVICE INCLUDING ENHANCED BEAM FOCUSING AND METHOD OF FABRICATION

CROSS-REFERENCE TO RELATED APPLICATION

This application claims priority to and the benefit of Korean Patent Application No. 10-2004-0038238 filed on May 28, 2004in the Korean Intellectual Property Office, the entire content of which is incorporated herein by reference.

BACKGROUND OF THE INVENTION

1. Field of the Invention

The present invention relates to an electron emission device, and in particular, to an electron emission device and a method of manufacturing the same which enhances the structure of a focusing electrode for controlling the electron beams and an insulating layer for supporting the focusing electrode.

2. Description of Related Art

Generally, electron emission devices are classified into a first type where a hot cathode is used as an electron emission source, and a second type where a cold cathode is used as the electron emission source.

Cold cathode electron emission devices include, for example, field emitter array (FEA) devices, surface conduction emitter (SCE) devices, metal-insulator-metal (MIM) devices, metal-insulator-semiconductor (MIS) devices, and ballistic electron surface emitting (BSE) devices.

Electron emission devices vary in their structure depending upon the specific type of the device. However, most have a basic structure including a vacuum chamber formed by two substrates, electron emission regions and driving electrodes that are formed on one of the substrates, and phosphor layers that are formed on the other substrate. The driving electrodes help emit electrons from the electron emission regions and phosphor layers emit light to display the desired images.

In an electron emission device with the above general structure, correcting the trajectory of electron beams to enhance the display characteristics has been a challenge. For example, electrons emitted from the electron emission regions on one of the substrates may diffuse before colliding against the phosphor layers on the other substrate. As a result, the diffused electrons do not strike the intended phosphor layers; instead, they land on other-neighboring phosphor layers causing them to emit an unintended color.

Metallic mesh-shaped grid electrodes or focusing electrodes have been used to control the trajectory of the electron beams. A grid electrode is placed between the two substrates while set apart from them using spacers. Focusing electrodes are located over the first substrate, which includes the electron emission regions, and surround the electron emission regions.

Fabrication of electron emission devices using grid electrodes involves difficult and complicated processing steps. At first, spacers are mounted on one of the two substrates; then, the grid electrode is aligned to the substrates; and then, the substrates are attached to each other to form a vacuum chamber.

Effective use of focusing electrodes may also lead to difficulty in the required fabrication process. The electron beam focusing effect of a focusing electrode is enhanced if the focusing electrode is set at a distance from the electron emission regions. To set the focusing electrode away from the electron emission regions, the thickness of the insulating layer, that supports the focusing electrode, must increase. An increased insulator thickness, in turn, results in longer and deeper opening portions, passage wells or holes through the insulator layer to the electron emission regions on the substrate. Forming holes with a high vertical to horizontal ratio involves fabrication processing difficulties. For example, if a wet etch process is used to form a hole, the etchant may tend to widen the hole as it deepens it. Therefore, achieving a deep hole while keeping the width small is not trivial.

SUMMARY OF THE INVENTION

In one exemplary embodiment of the present invention, there are provided an electron emission device and a method of manufacturing the same which improve the structure of a focusing electrode and an insulating layer for supporting the focusing electrode to thereby enhance the electron beam focusing effect.

In an exemplary embodiment of the present invention, an electron emission device includes one or more driving electrodes for controlling the emission of electrons from electron emission regions formed on a substrate. Two or more insulating layers are formed on the driving electrodes, and a focusing electrode is formed on the insulating layers. The insulating layers have opening portions exposing the electron emission regions on the substrate, and the opening portions of the insulating layers are differentiated in size from each other.

The insulating layer contacting the driving electrodes has a first opening portion, and the insulating layer contacting the focusing electrode has a plurality of second opening portions smaller than the first opening portion. The plurality of second opening portions are arranged within the area of the first opening portion. The insulating layers are differentiated in etching rate from each other, and the etching rate of the insulating layer placed apart from the focusing electrode is greater than the etching rate of the insulating layer placed close to the focusing electrode.

In another exemplary embodiment of the present invention, an electron emission device includes first and second substrates facing each other, and cathode and gate electrodes placed on the first substrate while being insulated from each other by interposing a lower insulating layer. Electron emission regions are electrically coupled to the cathode electrodes. A focusing electrode is placed on the electron emission regions while surrounding the electron emission regions. Two or more insulating layers are placed under the focusing electrode while supporting the focusing electrode. The insulating layers are based on different kinds of insulating materials with opening portions exposing the electron emission regions on the first substrate, and the opening portions of the insulating layers are differentiated in size from each other.

In a method of manufacturing the electron emission device, cathode and gate electrodes are first formed on a substrate. An insulating layer with a relatively high etching rate and an insulating layer with a relatively low etching rate are sequentially deposited onto the electrodes to form two or more insulating layers differentiated in etching rate from each other. A focusing electrode is formed on the insulating layers such that the focusing electrode has an opening portion with a predetermined size. The insulating layers are etched using the focusing electrode as a mask layer to thereby form an opening portion with a relatively large width at the insulating layer placed apart from the focusing electrode while forming a plurality of opening portions with relatively small widths at the insulating layer contacting the focusing electrode.

DETAILED DESCRIPTION

Figure 1:
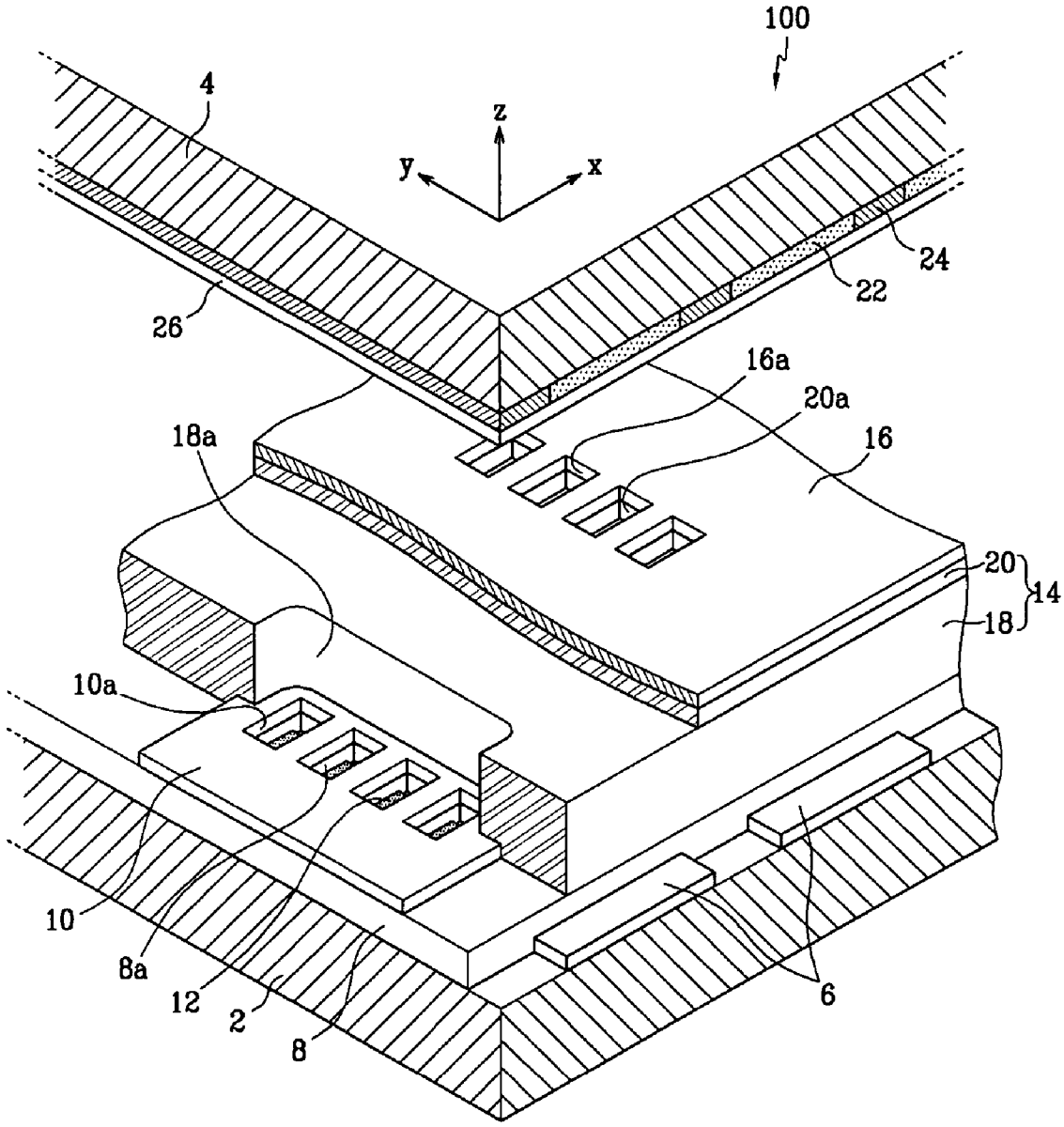
FIG. 1 is a partial perspective view of an electron emission device according to one embodiment of the present invention.
Figure 2:
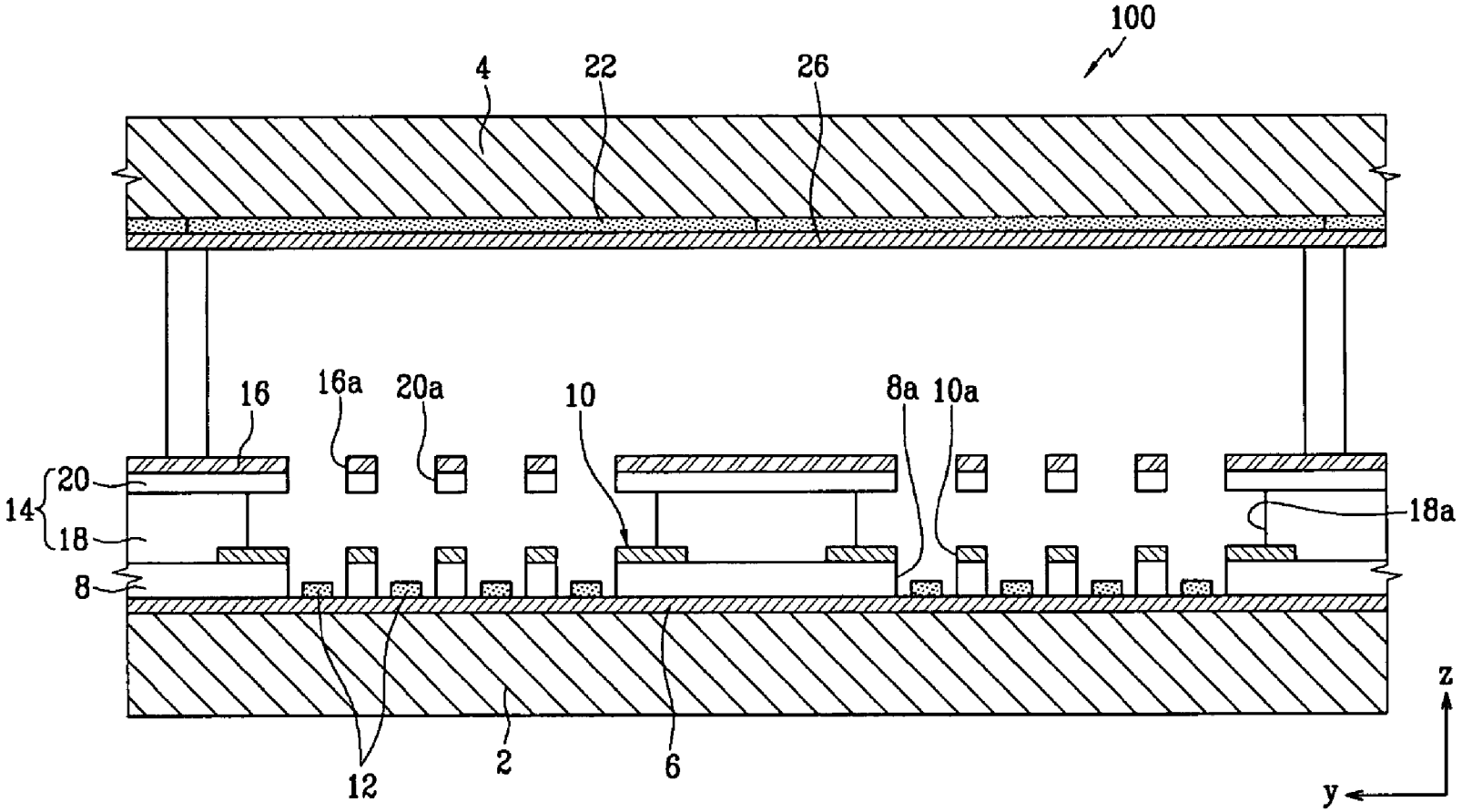
FIG. 2 is a partial cross-sectional view of the electron emission device shown in FIG. 1.

As shown in FIG. 1 and FIG. 2, one embodiment of the electron emission device of this invention 100 includes a first substrate 2 and a second substrate 4. The substrates 2, 4 are arranged in parallel while being apart from each other, leaving a space in between. The substrates 2, 4 are attached to each other by a spacer, to form a vacuum chamber outlining the device.

Cathode electrodes 6 may be formed with a stripe pattern on the first substrate 2 along one of the axes of the substrate. In FIG. 1, for example, the cathode electrodes 6 are formed in stripes along the y-axis of the drawing. A lower insulating layer 8 may be formed over the first substrate 2 covering the cathode electrodes 6. A number of gate electrodes 10 may be formed on the lower insulating layer 8. The gate electrodes 10 may be formed with a stripe pattern proceeding along a direction perpendicular to the direction of cathode electrodes 6. In FIG. 1, for example, the gate electrodes 10 are formed in stripes along the x-axis of the drawing.

In the embodiment shown in FIG. 1 and FIG. 2, regions where the cathodes 6 and the gate electrodes 10 cross paths may be defined as pixel regions. A number of electron emission regions 12 are formed on the cathode electrodes 6 at these pixel regions. Gate wells or holes 8*a*, 10*a* are formed through the first insulating layer 8 and the gate electrodes 10. The gate holes 8*a*, 10*a* correspond to the electron emission regions 12 and expose the electron emission regions 12 to the vacuum chamber formed between the two substrates 2, 4.

In one embodiment, shown in FIG. 1 and FIG. 2, the electron emission regions 12 are linearly arranged along the longitudinal direction of the cathode electrodes 6 in the pixel regions. If the electron emission regions 12 are formed to have a rectangular shape, then, the gate holes 8*a*, 10*a* may also be rectangular to correspond to electron emission regions 12 in plan view.

The electron emission regions 12 may be formed from a carbonaceous material or a nanometer-sized material that emit electrons when an electric field is applied to them. For example, the electron emission regions 12 may be formed with carbon nanotube, graphite, graphite nanofiber, diamond, diamond-like carbon, $C_{60}$, silicon nanowire, a combination of the foregoing, or any like material. The electron emission regions 12 may be formed through direct growth, screen printing, chemical vapor deposition, sputtering, or similar processes.

In the embodiment shown on FIG. 1 and FIG. 2, the cathode electrodes 6 and the gate electrodes 10 are insulated from each other by the lower insulating layer 8. In this embodiment, the gate electrodes 10 surround the electron emission regions 12. When driving voltages are applied to the cathode electrodes 6 and gate electrodes 10, electric fields are formed around the electron emission regions 12. The electric fields created by the voltage difference between the cathode and gate electrodes 6, 10, cause the electron emission regions 12 to emit electrons.

In the embodiment shown in FIG. 1 and FIG. 2, the gate electrodes 10 are placed above the cathode electrodes 6 with the lower insulating layer 8 separating the cathode electrodes 6 from the gate electrodes 10. Alternatively, in another embodiment (not shown), the gate electrodes 10 may be placed under the cathode electrodes 6 while the two are separated by the lower insulating layer 8. In this case, the electron emission regions 12 may be formed on one-side of a periphery of the cathode electrodes 6.

As shown in FIG. 1 and FIG. 2, an upper insulating layer 14 and a focusing electrode 16 are formed or placed over the gate electrodes 10 and the lower insulating layer 8. In the embodiment shown, opening portions 18*a*, 20*a* and 16*a* are formed for exposing the electron emission regions 12 to the inside of the vacuum chamber formed between the substrates 2, 4. The focusing electrode 16 are formed over the entire extent of the first substrate 2. Alternatively, the focusing electrode 16 may be divided into a number of portions with a predetermined pattern. The focusing electrode 16 may be formed from a metallic thin film by depositing a metallic material on the upper insulating layer 14. In another embodiment, the focusing electrode 16 may be formed by attaching a metal plate with opening portions 16*a* to the upper insulating layer 14.

The focusing electrode 16 is capable of focusing the electrons emitted from the electron emission regions 12, and when a high voltage is applied to the second substrate 4, prevents the electron emission regions 12 from being influenced by the electric field due to the high voltage. The gate electrode 10 and the focusing electrode 16 are separated by the upper insulating layer 14 to prevent the gate and focusing electrodes 10, 16 from contacting with each other and creating a short-circuit. The beam focusing effect of the focusing electrode 16 is enhanced as the thickness of the upper insulating layer 14 is increased.

In one embodiment, the upper insulating layer 14 may have a two-tiered structure with a first or lower tier 18 and a second or upper tier 20. Opening portions 18*a*, 20*a*, that may be holes, are formed through tiers 18, 20 of the double-tiered upper insulating layer 14 for exposing the electron emission regions 12 to the vacuum chamber. Each part of an opening portion 18*a*, 20*a* may have a different thickness or depth corresponding to the different thicknesses of the tiers 18, 20 of the double-tiered upper insulating layer 14. A relatively long opening portion 18*a* may be formed through the first or lower tier 18 of the insulating layer 14. A relatively short opening portion 20*a* may be formed through the second or upper tier 20 of the upper insulating layer 14 directed toward the focusing electrode 16. As a result, in this embodiment, the focusing electrode 16 will have a sufficient distance from the electron emission regions 12.

More than two tiers may be used to create the upper insulating layer 14. A several-tiered upper insulating layer 14 may be formed by depositing a sequence of insulating layers of different thickness and characteristics.

In one embodiment, the upper insulating layer 14 may have a laminated structure of the first or lower insulating tier 18 and the second or upper insulating tier 20. When an opening portion 18*a* is formed through the first insulating tier 18, one or more opening portions 20*a*, 16*a* may be formed through the second insulating tier 20 and the focusing electrode 16 corresponding to the opening portion 18*a*. The opening portion 18*a* of the first insulating tier 18 may be formed at pixel regions. Then, one or more opening portions 20*a*, 16*a* are formed through the second insulating tier 20 and the focusing electrode 16, also, at each pixel region. So, one opening portion 18*a* of the first or lower insulating tier 18 may correspond to several opening portions 20*a*, 16*a* through the second or upper insulating tier 20 at each pixel region.

In some embodiments, the opening portions 18*a* formed in the first insulating tier 18 of the upper insulating layer 14 may have a larger cross-sectional area than the opening portions 20*a* formed in the second insulating tier 20. In these embodiments, the first or lower tier 18 functions as support for the second or upper tier 20 and for the focusing electrode 16. The second insulating tier 20 has opening portions 20*a* with smaller cross-sectional areas. The smaller area of the second or upper opening portions 20*a*, allows intricate patterns for the opening portions 16*a*, of the focusing electrode 16, that are formed over opening portions 20*a*. Again, considering the respective functions of the first and the second insulating tiers 18, 20, the first or lower insulating tier 18 is usually formed with a larger thickness and the second or upper insulating tier 20 is formed with a smaller thickness. In some embodiments, the thickness of the first insulating tier 18 may be one to five times greater than the thickness of the second insulating tier 20.

In some embodiments, the first and the second insulating tiers 18, 20 are formed with different kinds of materials, which exhibit different etching rates with respect to an etching solution or an etching gas. In these embodiments, the upper insulating layer 14 can be easily removed to create the required opening portions 18*a*, 20*a* through one etching process. For example, if the thickness of first insulating tier 18 is greater than the thickness of the second insulating tier 20, then if the etching rate of the first insulating tier 18 is also greater than that of the second insulating tier 20, the two layers may be removed in one etch step. For example, when it is intended to etch through the upper insulating layer 14 by one wet etching process and the first insulating tier 18 is ten to twenty times as thick as the second insulating tier 20, then the etching rate of the first insulating tier 18 may be established to be ten to twenty times greater than that of the second insulating tier 20.

In embodiments where more than two tiers are used to form the upper insulating layer 14, the respective functions of each tier determine the thickness and the etch rate of each tier.

As seen in FIG. 1 and FIG. 2, red, green, and blue phosphor layers 22 are formed on the surface of the second substrate 4 facing the first substrate 2. A black layer 24 is formed between the neighboring phosphor layers 22. An anode electrode 26 is formed on the phosphor layers 22 and the black layers 24. The anode electrode 26 may be formed with a metallic layer, for example, an aluminum layer formed through deposition. The anode electrode 26 is coupled to a high voltage from outside to accelerate electron beams. The anode electrode 26 may also reflect some of the visible rays radiated toward the first substrate 2 back toward the second substrate 4, thereby heightening the screen brightness.

In one embodiment (not shown), the anode electrode 26 may be formed with a transparent conductive material, such as indium tin oxide (ITO). In this embodiment, the anode electrode 26 is formed under the phosphor layers 22 and the black layers 24 and directly on the second substrate 4. This anode electrode 26 may be formed on the entire surface of the second substrate 4, or divided into a number of portions with a predetermined pattern covering only parts of the second substrate 4.

As described above, the upper insulating layer 14 for supporting the focusing electrode 16 is formed over a laminated structure of first and second insulating tiers 18, 20. The fist and second insulating tiers 18, 20 have opening portions 18*a*, 20*a* with different thicknesses and different cross-sectional areas so that the focusing electrode 16 has a sufficient height with respect to the electron emission regions 12, and the opening portions 16*a* of the focusing electrode 16 may be minutely patterned.

Consequently, the electron emission device 100 involves an enhanced electron beam focusing effect, and shields the anode electric field with respect to the electron emission regions 12 more effectively, thereby preventing the unintended light emission.

FIG. 1 and FIG. 2, show an embodiment of the electron emission device 100 where for every electron emission region 12 and its corresponding gate hole 8*a*, 10*a* , there is one opening portion 16*a*, 20*a* formed through the focusing electrode 16 and the second insulating tier 20.

Figure 3:
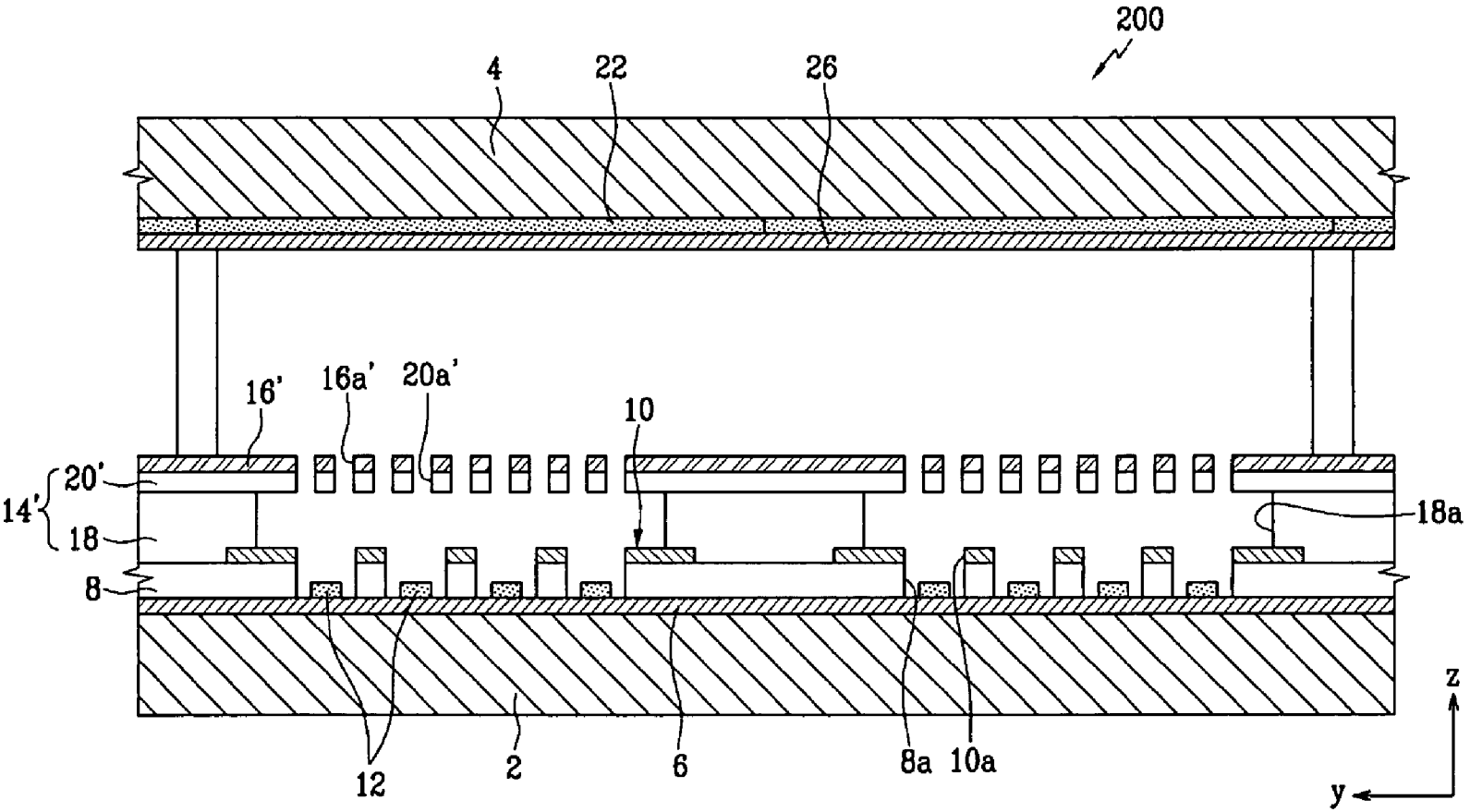
FIG. 3 is a partial cross-sectional view of an electron emission device according to another embodiment of the present invention.
Figure 4:
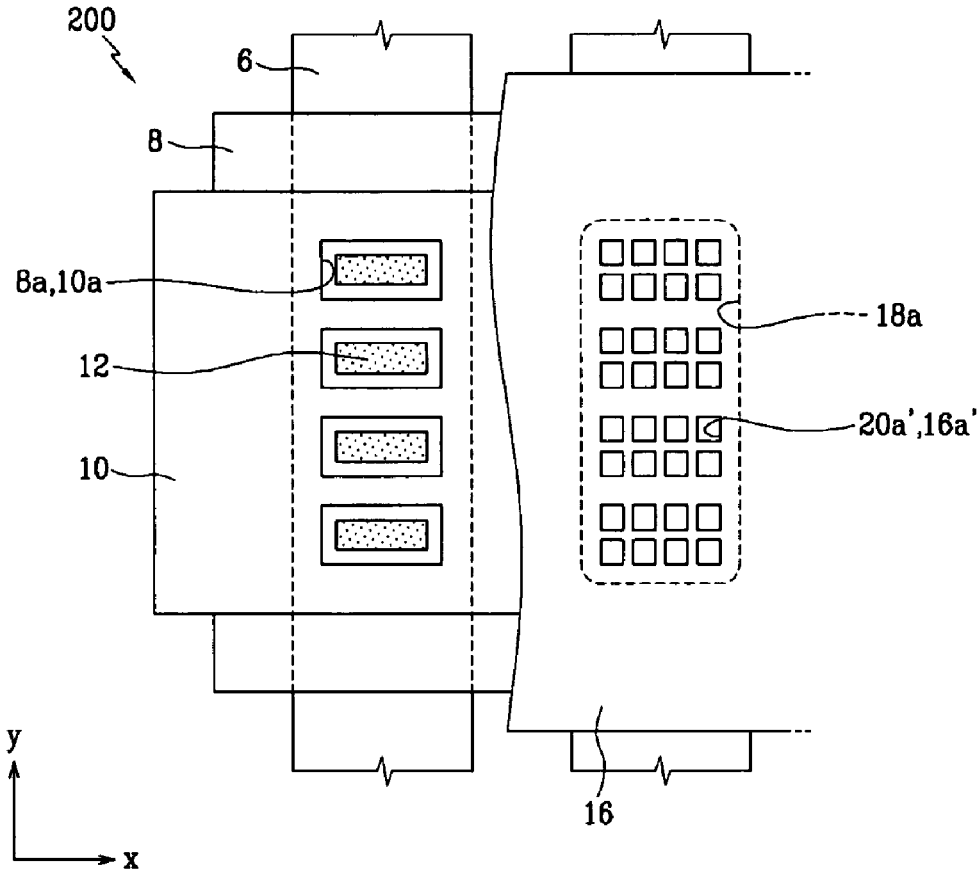
FIG. 4 is a partial plan view of the electron emission device shown in FIG. 3.

FIG. 3 and FIG. 4 show an alternative embodiment of the electron emission device 200 where for every electron emission region 12 and its corresponding gate hole 8*a*, 10*a*, there are a number of opening portions 16*a*', 20*a*' formed through the focusing electrode 16' and the second insulating tier 20'.

A method of manufacturing the electron emission device 100, 200 will be now explained with reference to FIGS. 5A to 5D.

Figure 5A:
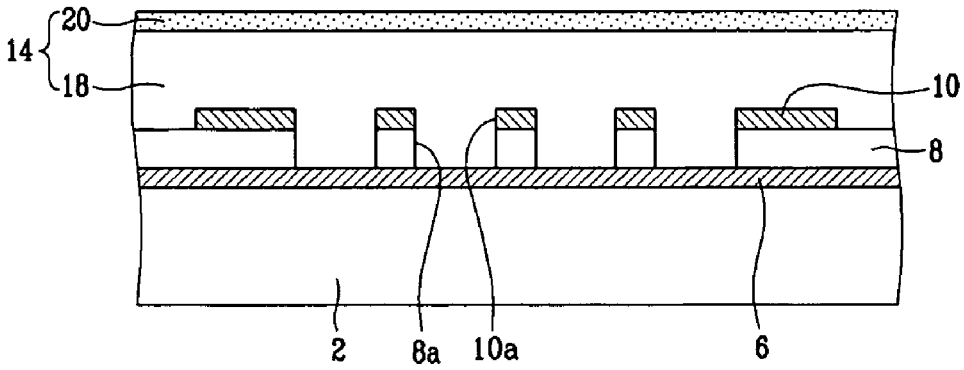
FIGS. 5A to 5D illustrate exemplary fabrication steps of an electron emission device of the present invention.

As shown in FIG. 5*a*, cathode electrodes 6, a lower insulating layer 8 and gate electrodes 10 are sequentially formed on a first substrate 2, and at least one gate hole 8*a*, 10*a* is formed through the lower insulating layer 8 and the gate electrode 10 per each pixel region such that the cathode electrode 6 is partially exposed.

First and second insulating tiers 18, 20, forming an upper insulating layer 14, are deposited onto the surface of the first substrate 2, over the gate electrodes 10 and the lower insulating layer 8. The first and the second insulating tiers 18, 20 are formed with materials with different etch rates with respect to an etching solution or an etching gas. For example, the etching rate of the first insulating tier 18 may be ten to twenty times greater than that of the second insulating tier 20.

The first insulating tier 18 supports the focusing electrode 16 to be formed later and may repeatedly suffer printing and firing. For example, the thickness of the first insulating tier 18 may vary from several micrometers to tens of micrometers. The second insulating tier 20 has a role of forming minute opening portions 20*a* adjacent to the focusing electrode 16 to be formed later. For example, the thickness of the second insulating tier 20 may be several micrometers to tens of micrometers.

Figure 5B:
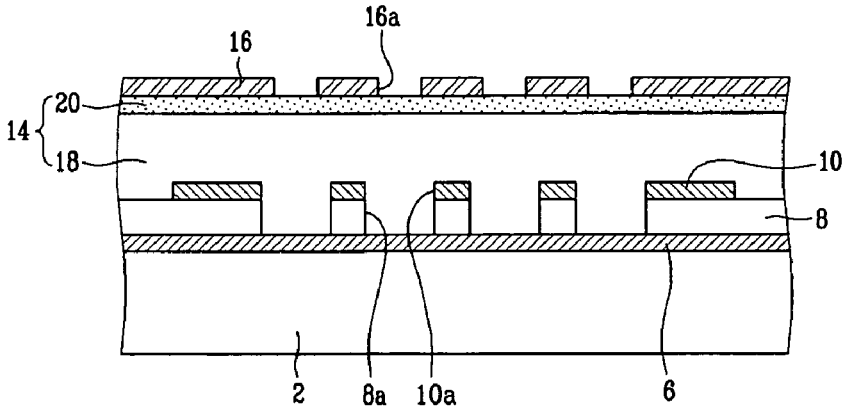

As shown in FIG. 5B, a focusing electrode 16 is formed on the second insulating tier 20 with opening portions 16*a*. For formation of the focusing electrode 16, a metallic material may be deposited onto the second insulating tier 20, and patterned. For this purpose, a thin metal plate including opening portions 16*a*, may be attached to the second insulating tier 20.

As shown in FIG. 5B, the opening portions 16*a* of the focusing electrode 16 are arranged in one to one correspondence with the gate holes 8*a*, 10*a* of the lower insulating layer 8 and the gate electrodes 10. As shown in FIGS. 3 and 4, a number of opening portions 16*a* may correspond to one gate hole 8*a*, 10*a*.

Figure 5C:
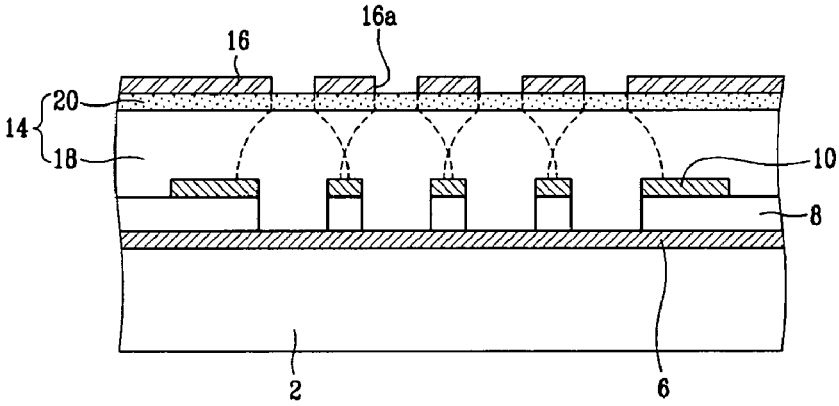

Thereafter, as shown in FIG. 5C, the upper insulating layer 14 are etched using the focusing electrode 16 as a mask layer. A wet etching process may be used for the etching. When the upper insulating layer 14 is etched using the focusing electrode 16 as a mask layer, a number of opening portions 20*a* are formed through the second insulating tier 20 in conformity with the shape of the focusing electrode 16. At the same time, the first insulating tier 18 is over-etched so that the opening portions 18*a* are interconnected forming one large opening volume.

Figure 5D:
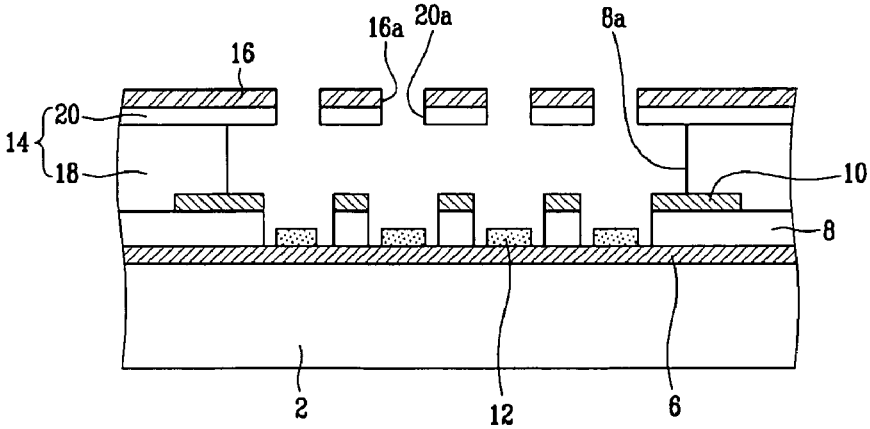

Consequently, in an embodiment shown in FIG. 5D, the first insulating tier 18 has an opening portion 18*a* with a large width or cross-sectional area, and the second insulating tier 20 and the focusing electrode 16 have a number of opening portions 20*a*, 16*a* over the opening portion 18*a* of the first insulating tier 18.

Finally, a paste containing an electron emission material and a photosensitive material is screen-printed onto the cathode electrodes 6, and exposed to light, followed by developing and firing to form electron emission regions 12 on the cathode electrodes 6.

The first substrate 2, with an electron emission structure, faces a second substrate 4, with phosphor layers 22 and an anode electrode 26, and the two substrates 2, 4 are separated by a predetermined distance. The two substrates 2, 4 are attached by using a sealing material, such as a frit. The inner space between the first and the second substrates 2, 4 is partially exhausted and kept in a partial vacuum state, thereby forming an electron emission device.

As described above, with the electron emission device of this invention 100, 200, the focusing electrode 16 has a sufficient height with respect to the electron emission regions 12, and the opening portions 16*a*, 16*a*' of the focusing electrode 16 are small. Accordingly, the electron beam focusing effect by way of the focusing electrode 16 is enhanced, and the anode electric field with respect to the electron emission regions 12 is intercepted more effectively.

Although exemplary embodiments of the present invention have been shown and described, those skilled in the art would appreciate that changes may be made in the embodiments without departing from the principles and spirit of the invention, the scope of which is defined in the claims and their equivalents.

What is claimed is:

1. An electron emission device comprising:

driving electrodes for controlling emission of electrons from electron emission regions formed on a substrate;

an insulating layer over the driving electrodes, the insulating layer having a first insulating tier over one of the driving electrodes and a second insulating tier over the first insulating tier; and a focusing electrode over the insulating layer, wherein the first insulating tier and the second insulating tier have opening portions exposing the electron emission regions on the substrate, and wherein the opening portions of the first insulating tier are different from the opening portions of the second insulating tier in thickness, or in cross-sectional area, or in both thickness and cross-sectional area, and wherein the first insulating tier has a plurality of first opening portions and the second insulating tier has a plurality of second opening portions such that two or more of the second opening portions interface with a corresponding one of the first opening portions.

2. The electron emission device of claim 1, wherein:

the first insulating tier is on said one of the driving electrodes;

the second insulating tier is on the first insulating tier; and the plurality of second opening portions are smaller in size than the first opening portions.

3. The electron emission device of claim 2, wherein the two or more of the second opening portions are within the area of the corresponding one of the first opening portions.

4. The electron emission device of claim 1, wherein the first insulating tier and the second insulating tier have different etching rates.

5. The electron emission device of claim 4, wherein an etching rate of the first insulating tier is greater than an etching rate of the second insulating tier.

6. The electron emission device of claim 1, wherein the driving electrodes comprise cathode electrodes and gate electrodes, and wherein the cathode electrodes are insulated from the gate electrodes.

7. The electron emission device of claim 1, wherein the insulating layer comprises two or more insulating layers, the first insulating tier being a first one of the insulation layers and the second insulating tier being a second one of the insulation layers.

8. An electron emission device comprising:

a first substrate and a second substrate facing the first substrate;

cathode electrodes and gate electrodes on the first substrate while being insulated from each other by a lower insulator layer in between;

electron emission regions on the first substrate, the electron emission regions being electrically coupled to the cathode electrodes;

two or more insulating tiers over the cathode electrodes and the gate electrodes; and a focusing electrode over the insulating tiers and supported by the insulating tiers, the focusing electrode being above the electron emission regions while surrounding the electron emission regions, wherein the insulating tiers are formed from different insulating materials, wherein the insulating tiers comprise opening portions exposing the electron emission regions, wherein the opening portions of different insulating tiers are different from one another, in thickness, or in cross-sectional area, or in both thickness and cross-sectional area, and wherein the insulating tiers comprise a first insulating tier and a second insulating tier, the first insulating tier having a plurality of first opening-portions, the second insulating tier having a plurality of second opening portions such that two or more of the second opening portions interface with a corresponding one of the first opening portions.

9. The electron emission device of claim 8, wherein the first insulating tier is apart from the focusing electrode; and the second insulating tier is between the first insulating tier and the focusing electrode, the two or more of the second opening portions being within the corresponding one of the first opening portions, the second opening portions being smaller in size than the first opening portions.

10. The electron emission device of claim 9, wherein the cathode electrodes and the gate electrodes are stripe-patterned and perpendicular to each other, forming crossed regions where the cathode electrodes and the gate electrodes cross, and wherein one or more electron emission regions are at each of the crossed regions.

11. The electron emission device of claim 10, wherein the first opening portions correspond to the crossed regions, and wherein one or more of the second opening portions and opening portions of the focusing electrode are formed at each of the electron emission regions.

12. The electron emission device of claim 9, wherein the first insulating tier and the second insulating tier have different etching rates.

13. The electron emission device of claim 12, wherein the etching rate of the first insulating tier is ten to twenty times greater than the etching rate of the second insulating tier.

14. The electron emission device of claim 9, wherein the first insulating tier and the second insulating tier have different thicknesses.

15. The electron emission device of claim 14, wherein the thickness of the first insulating tier is one to five times larger than the thickness of the second insulating tier.

16. The electron emission device of claim 8, wherein the electron emission regions are formed from a material selected from the group consisting of carbon nanotube, graphite, graphite nanofiber, diamond, diamond-like carbon, $C_{60}$, and silicon nanowire.

17. The electron emission device of claim 8, further comprising:

phosphor layers on the second substrate; and one or more anode electrodes on the phosphor layers.

* * * * *